US005954077A

United States Patent [19]

Wain et al.

[11] Patent Number: 5,954,077

[45] Date of Patent: Sep. 21, 1999

[54] MULTIPURPOSE TENT POLE TERMINATION DEVICE

[75] Inventors: Hans M. Wain, Truckee; Gary A. Fraze, Alta Loma, both of Calif.

[73] Assignee: Jinwoong, Inc., Fremont, Calif.

[21] Appl. No.: 08/688,171

[22] Filed: Jul. 29, 1996

[51] Int. Cl.[6] ..... E04H 15/64

[52] U.S. Cl. ..... 135/119; 135/120.1; 135/120.3

[58] Field of Search ..... 135/114, 119, 135/120.1, 120.2, 120.3, 120.4, 115, 907; 248/499, 508; 403/405.1, 407.1; 24/265.1, 698.1

[56] References Cited

U.S. PATENT DOCUMENTS

| | | | |
|---|---|---|---|
| 2,714,386 | 8/1955 | Worsham | 135/115 |
| 3,432,609 | 3/1969 | Duvall et al. | 135/115 X |
| 3,830,457 | 8/1974 | Stewart | 248/508 X |
| 3,870,428 | 3/1975 | Jackson | 248/508 X |
| 3,970,096 | 7/1976 | Nicolai | 135/115 X |
| 4,029,117 | 6/1977 | Rain | 135/119 X |
| 4,072,158 | 2/1978 | O'Brien et al. | 135/116 |
| 4,078,572 | 3/1978 | Moss | 135/125 X |
| 4,192,333 | 3/1980 | Sato | 135/124 |
| 4,195,651 | 4/1980 | Watts et al. | 135/120.3 X |
| 4,236,543 | 12/1980 | Moss | 135/116 |
| 4,782,846 | 11/1988 | Ting | 135/120.3 |
| 5,042,219 | 8/1991 | Fricker | 52/712 X |
| 5,333,634 | 8/1994 | Taylor | 135/98 |
| 5,345,962 | 9/1994 | Moss | 135/102 |
| 5,404,896 | 4/1995 | Howe | 135/125 |
| 5,573,028 | 11/1996 | Van Der Stigohel | 135/119 X |
| 5,615,699 | 4/1997 | Lee | 135/119 X |

FOREIGN PATENT DOCUMENTS

| | | | |
|---|---|---|---|
| 287424 | 4/1953 | Switzerland | 135/119 |

*Primary Examiner*—Carl D. Friedman
*Assistant Examiner*—Timothy B. Kang
*Attorney, Agent, or Firm*—Raymond E. Roberts; Michael J. Hughes

[57] ABSTRACT

A tent pole base bracket (10) having at its outer end (18) a termination hook (24) for receiving attachment of common tent options like canopies, tarpaulins, and rain flies. The preferred form of the bracket (10) has a pass through slot (30) located at its inner end (20) for accepting a web strap from a tent wall, which may be permanently or temporarily attached to the bracket (10). Roughly central to the bracket (10) a pole orifice (34) is provided for receiving the end of a tent pole. The bracket (10) may have a base curved shape (38) to permit it to rock into a position that optimally handles stresses received concurrently from tent wall fabric, a tent pole, and an attached canopy. Further, the bracket (10) may be constructed so that a defined pole axis (40) and a defined hook axis (42) may be substantially parallel in use of the bracket (10). Optional features of the bracket (10) include stiffening ribs (26 and 28) on the termination hook (24) and a strengthening rim (36) around the tent pole orifice (34), on the upper side (12) of the bracket (10).

8 Claims, 2 Drawing Sheets

MULTIPURPOSE TENT POLE TERMINATION DEVICE

TECHNICAL FIELD

The present invention relates generally to tents, and more particularly to tent pole termination devices commonly called base brackets which are used for attachment of tent materials, tent poles, and tent options such as canopies, tarpaulins, and rain flies.

BACKGROUND ART

One of the earliest forms of shelter known to humankind is the tent. Huge variety in tent design exists, but common elements include tent fabric and tent poles which shape and support the fabric. Many tent designs also include options such as canopies, tarpaulins, and rain flies. To connect all of these tent components together, and concurrently provide a mechanism for holding them together at the surface upon which a tent is assembled many tents use a special tent pole terminating device at the lower end of each tent pole. In the industry such terminators have come to be called tent base brackets, and most frequently they are separate pieces assembled onto tent poles during the process of tent erection.

Unfortunately, current tent base brackets are not perfect. Like any device, if built to be robust, the weight added may be appreciable, and if built light the brackets may be weak and wear or break easily. Particularly since portability of tents is often important, concerns like choice of sturdy materials, dimensional bulk, and weight for base brackets become quite important. Further, other tent design concerns like ease of assembly, disassembly, use, packing, and storage all should be facilitated by the base bracket. Still further, since base brackets are usually critical to tent integrity, they must not be easily lost.

What is needed is an improved tent base bracket which will perform the tasks of attachment of tent wall fabric, supporting a tent pole, and attachment of tent options while suitably dissipating forces transferred from all of these. The optimal device should have adequate strength and durability as well as light weight, and should preferably attach permanently to some larger structure of the tent, to minimize the likelihood of loss. Further, the device should not interfere with other parts of the tent or its assembly.

DISCLOSURE OF INVENTION

Accordingly, it is an object of the present invention to provide a tent base bracket adapted to accept attachment to tent fabric materials, insertion of a tent pole, and attachment of a tent option such as a canopy.

Another object of the invention is to provide a base bracket which may be attached, either temporarily or permanently, to tent fabric materials.

And, another object of the invention is to provide a base bracket which is strong and durable, yet is light in weight and uses little material.

Briefly, a preferred embodiment of the present invention is a bracket formed with top and bottom sides, and an edge separating these. The bracket has inner and outer ends, defined by the orientation of the bracket to a tent in which it is used, and between these is a central region. The bracket includes a capability for attachment to tent wall fabric at the inner end, an orifice for insertable retention of a tent pole in the central region, and a termination hook for attachment of a tent option such as a canopy at the outer end.

An advantage of the present invention is that it accommodates attachment needs for three major tent components (tent wall fabric, tent pole, and a canopy sheet), yet does so in a very small and easily used unit. The bracket accepts and balances stresses from all three of these attached components. In particular, the present invention may be used with common single bar tension locks in a manner that permits such locks to be used to adjustably tension the tent option which it is attached to.

A further advantage of the bracket is that it may be constructed of numerous materials having wide range of weight and cost. Accordingly, the inventive bracket may be optimally designed and constructed to emphasize low weight, low cost, high strength, or other desirable characteristics for particularized applications. Further the invention may be constructed in shapes best utilizing the material of construction to obtain high durability and strength, while dissipating stresses well.

A further advantage of the bracket is that it may be constructed to function ergonomically and safely. A number of features of the preferred embodiment inherently provide purchase points facilitating a users ability to securely grasp the bracket. The bracket also may have optional features added which further facilitate a users ability to grip the bracket. Examples include addition at suitable locations of projections which improve grip and suitably shaping the body of the bracket at key points to fit human finger tips.

A further advantage of the invention is that it may be attached, either temporarily or permanently, to the fabric material of tents. If permanently attached, the likelihood of loss of the bracket is reduced.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
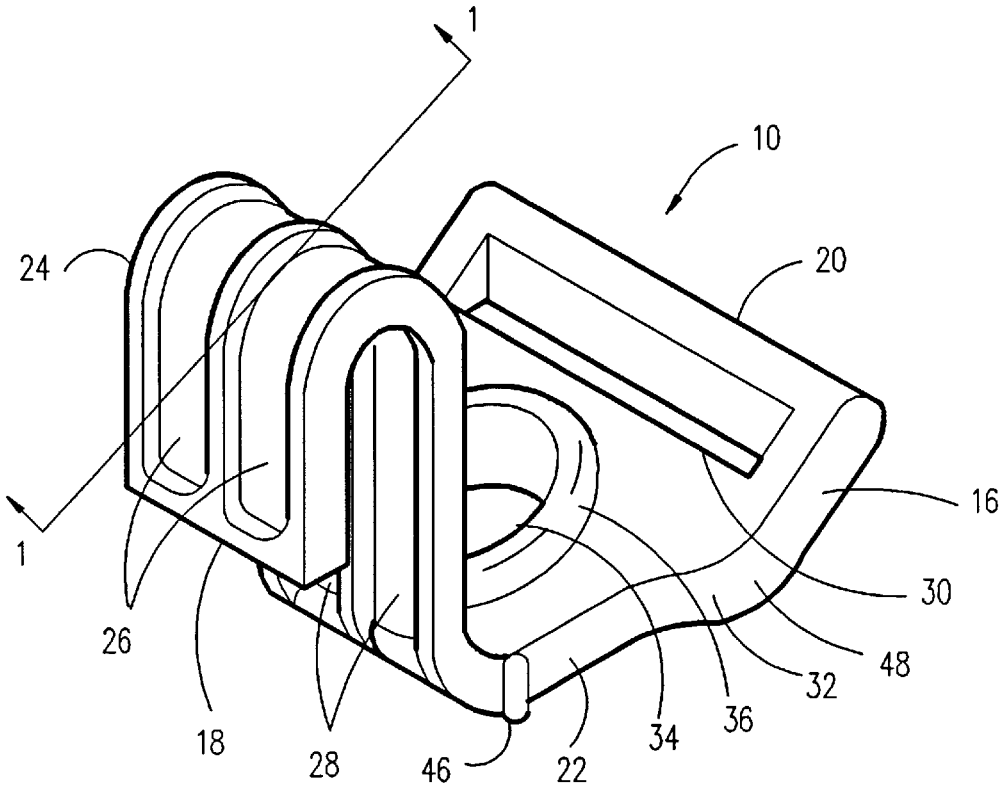
FIG. 1 is a perspective view of the upper side of the inventive bracket.

A preferred embodiment of the present invention is a base bracket for tent poles, which other tent materials and tent options can be attached to. As illustrated in the various drawings herein, and particularly in the view of FIG. 1, the preferred embodiment of the inventive device will herein be depicted by the general reference character 10.

Figure 2:
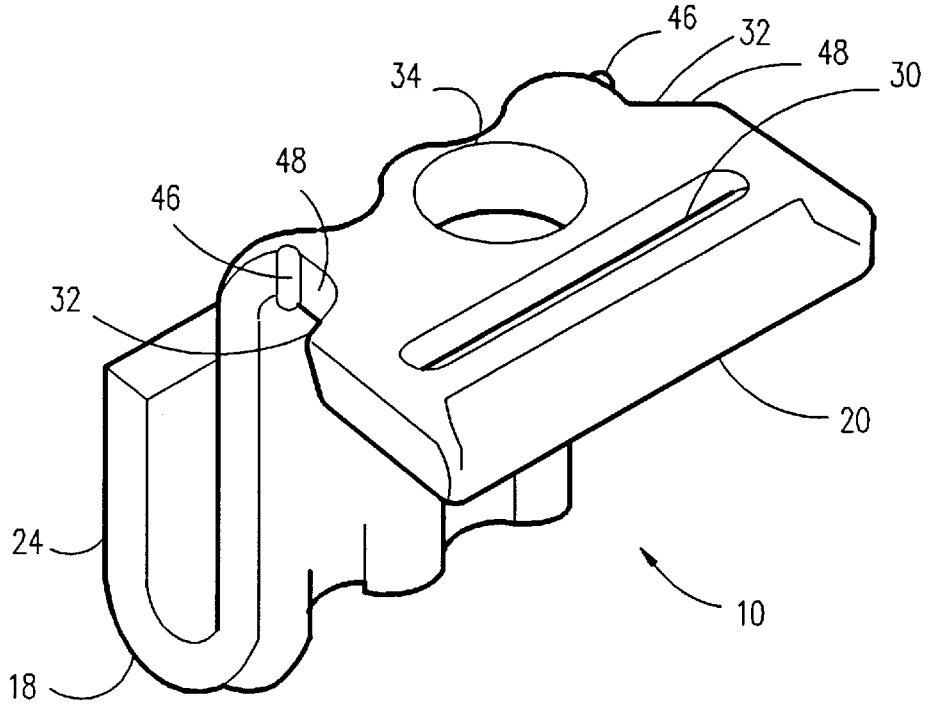
FIG. 2 is a perspective view of the underneath side of the bracket of FIG. 1.
Figure 3:
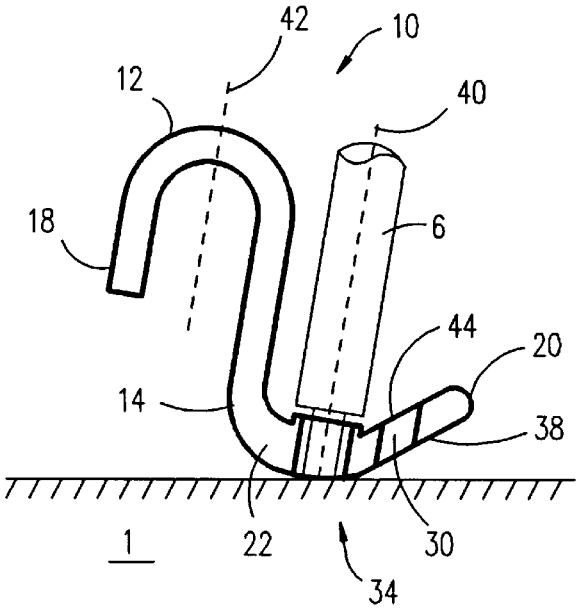
FIG. 3 is a cross-sectional view of section 1—1 of FIG. 1, illustrating alignment relationships of the bracket in use.

FIG. 1 and 2 illustrate the major features of the preferred embodiment of the inventive bracket 10 in perspective, while FIG. 3 provides a cross-sectional view to illustrate some more subtle features. Regions of the body of the bracket 10 are defined as an upper side 12; a lower side 14, opposite the upper side 12, which in use is oriented closest to a tent mounting surface (henceforth referred to as the ground 1, although tents are not always assembled on earthen surfaces); an edge 16; a hook end 18 (in orientation an outer end), which in use is oriented most distal from an assembled tent 2 (FIG. 4); a web end 20 (in orientation an inner end), which in use is oriented most proximate to an assembled tent 2; and a central portion 22, located roughly between the hook end 18 and the web end 20 of the bracket 10.

Figure 4:
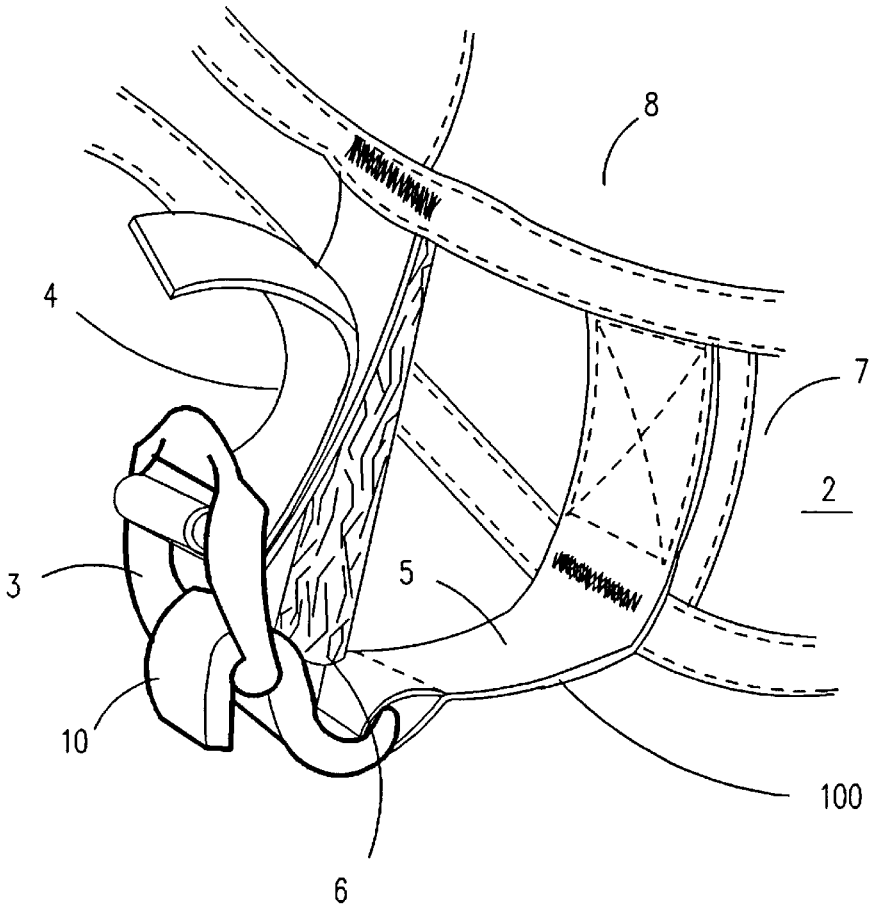
FIG. 4 is an illustration of the bracket in use in an assembled tent having a rain fly.

The hook end 18 of the bracket 10 is shaped to form a termination hook 24, which functions as an attachment point for common tent options such as tarps, canopies, and rain flies (an attached single bar tension lock 3 on the end of a tent option web strap 4 is shown in FIG. 4). (Herein the term canopy will be used in a generic sense to mean any of the above tent options.) On the upper side 12 of the bracket 10 at the hook end 18 upper stiffening ribs 26 are provided. Similarly, lower stiffening ribs 28 are provided in the lower side 14 of the termination hook 24 near the central portion 22 of the bracket 10. The stiffening ribs 26 and 28 are entirely optional, and when provided may be varied in number, shape, and arrangement. However, their presence has been found advantageous by the inventors for maintaining bracket 10 strength while reducing material usage and weight. Further, the stiffening ribs 26 and 28 somewhat facilitate user ability to grip the bracket 10 when setting up a tent 2 (a goal explained below).

The web end 20 of the bracket 10 has a web pass through slot 30, where a tent web strap 5 from the body of a tent 2 is attachable to the bracket 10, in either a permanent or temporary manner (the figures show permanent attachment, which is usually desirable to prevent loss of the brackets 10). The orientation of the pass through slot 30 is perpendicular to the expected direction of stress transfer from the tent web strap 5, when it is attached to the bracket 10. Further, the web end 20 of the bracket 10 is suitably shaped to dissipate stress transferred by a tent web strap 5 into the bracket 10, by having provided a suitable tapering shape 32, which after encompassing the pass through slot 30, the web end 20 narrows as the central portion 22 is approached. It should be noted that the use of a slot shape for connecting the tent web strap 5, and the use of tapering shape 32 are aspects of the presently preferred embodiment. Use of shapes other than a slot, or making the bracket 10 large enough that a taper provides no material reduction advantage, are possible for example. Accordingly, the spirit of the invention should not be interpreted too restrictively.

The central portion 22 of the bracket 10 includes a pole orifice 34, which is surrounded on the upper side 12 of the bracket 10 by a rim 36. While optional, the rim 36 provides strength and support to maintain the integrity of the pole orifice 34 when a tent pole 6 is inserted into it.

The lower side 14 of the bracket 10 in the central portion 22 contains a particularly important inventive feature. When in use, as shown in the cross-sectional view in FIG. 3, a suitably chosen base curve shape 38 permits the bracket 10 to rock into position and orient a pole axis 40, defined as central through an inserted tent pole 6 to parallel that of a central hook axis 42, defined by the angle of force applied by a canopy attached to the termination hook 24 (shown in FIG. 3). Further, in the preferred embodiment, walls 44 of the pass through slot 30 are also made parallel to these axes (40 and 42). All of these parallel relationships provide better stress transfer from an option web strap 4, a tent web strap 5, and a tent pole 6 into the bracket 10.

A number of optional features are included in the inventive bracket 10 to facilitate users gripping it securely. It should be appreciated that tents, their supporting pole structures, and options attached to them are all kept in a state of dynamic tension when assembled together. Further, tents often must be assembled and disassembled in slippery and wet conditions, and in situations where cold may have numbed a user's hands or motivated them to wear hand covers like gloves which reduce their ability to manipulate objects. Therefore, grip tangs 46 are provided in the preferred embodiment of the bracket 10, one to either edge of the central portion 22. The grip tangs 46, and to lessor extents also the stiffening ribs (26 and 28) and the tapering shape 32 of the web end 20 (i.e., accomplishing the taper with an edge curve shape 48 suitably located at the edges 16) all cooperate to provide purchase for users to grasp the bracket 10 securely.

FIG. 4 depicts the inventive bracket 10 in application. The bracket 10 is shown permanently attached to a tent 2 by a tent web strap 5, which extends from a tent wall 7. Also shown is a tent pole 6 entering the pole orifice 34 of the bracket 10. And, further shown is an option web strap 4 from a canopy 8 which ends with a single bar tension lock 3, which is hooked onto the termination hook 24 of the bracket 10. The tent web strap 5 is shown without a tent stake loop, to avoid obscuring details of the inventive bracket 10. However, it should be noted that conventional practice is to extend tent web straps out to a point more distal from the tent 2 than the hook end 18 of the bracket 10, for attachment to a tent stake driven into the ground. From FIG. 4 it can readily be appreciated that the inventive bracket 10 suitably holds the tent 2 (via the transfer of stress through the tent web strap 5), the tent pole 6, and the canopy 8 (via the transfer of stress through the option web strap 4) all in a suitable tensioned relationship. Further, when used in the manner depicted in FIG. 4, with the option web strap 4 having the single bar tension lock 3 (a conventional component in all respects; note that it is the manner that the inventive bracket 10 permits its use that is important here) positionally adjustable along the length of the option web strap 4, the tension on the option web strap 4 is adjustable. Still further, the bracket 10 inherently suggests proper orders of assembly and disassembly (e.g., for assembly, working outward, the brackets 10 are stretched out to roughly desired locations, the tent poles 6 are then inserted into the brackets 10, and finally the canopy 8 is stretched over the tent 2 and hooked onto the bracket 10 with single bar tension locks 3, which remain outer most and quite readily accessible for later disassembly).

In addition to the above mentioned examples, various other modifications and alterations of the inventive bracket 10 may be made without departing from the invention. Accordingly, the above disclosure is not to be considered as limiting and the appended claims are to be interpreted as encompassing the entire spirit and scope of the invention.

INDUSTRIAL APPLICABILITY

The tent-base bracket 10 according to the present invention is well suited for use with many popular tent styles. In tent designs where low weight or minimum material use are important, the variety of possible fabrication materials (e.g., plastics or metals) facilitate meeting these goals while still providing sufficient strength and robustness for the intended purpose of the bracket 10. The bracket 10 may also be constructed with optional features, such as the stiffing ribs 26 and 28, which further address these goals.

The termination hook 24 of the bracket 10 provides an attachment point for common tent options, such as rain flies and canopies, which in turn may have optional tensioning capability which is unimpeded by the bracket 10. Further, the inventive bracket 10 while fulfilling the typical duties of tent base brackets as a pole termination device is also capable of permanent attachment to the fabric portions of tents (e.g., the tent web strap 5 in the above disclosure), thereby reducing the possibility of loss and the attendant possibility of tents being rendered unusable for lack of instances of such a critical component.

The tent base bracket 10 is also ergonomic and easy to use. Users'ability to grip the bracket 10 and to use it safely even in trying conditions are facilitated by optional features such as the grip tangs 46 and suitable choices of shapes for other features, such as the stiffening ribs 26 and 28 noted above, as well as the edge curve shape 48 of the tapering shape 32.

For the above and other reasons, it is expected that the bracket 10 of the present invention will have widespread industrial applicability. Therefore, it is expected that the commercial utility of the present invention will be extensive and long lasting.

We claim:

1. A tent pole base bracket for use with a camping tent, the bracket consisting of:

a body;

said body having defined an inner end, an outer end opposite said inner end, a central portion between said inner end and said outer end, an upper side, a lower side, and an edge; and said body further having a tent pole orifice, located in said central portion and passing from said upper side to said lower side, for insertable retention of a tent pole; and a termination hook at said outer end of said body, for attachment of a canopy sheet; and tent wall fabric attachment means at said inner end of the base bracket.

2. The bracket of claim 1, wherein:

said tent pole orifice includes a rim on said upper side of the bracket, to strengthen and maintain structural integrity when the tent pole is inserted therein.

3. The bracket of claim 1, wherein:

said termination hook includes at least one stiffening rib, to strengthen and maintain structural integrity when the canopy sheet is attached thereto.

4. The bracket of claim 1, wherein:

said body of said bracket includes grip enhancing means, to facilitate grasp of the bracket by a user.

5. The bracket of claim 1, wherein:

said grip enhancing means includes a plurality of tangs projecting from said edge of the bracket, to facilitate the user's grasping the bracket between a thumb and forefinger.

6. The bracket of claim 5, wherein:

said grip enhancing means further includes said inner end being suitably shaped and said tangs being suitably distally located along said edge so that tips of the user's thumb and forefinger may grasp the bracket securely.

7. The bracket of claim 1, wherein:

said body of said bracket has defined a base region extending from the inner end to encompass the central portion along the lower side of the bracket;

said base region having a suitable curve, to permit the bracket to longitudinally rock into position when stresses are applied to the bracket by the tent wall fabric, the tent pole, and the canopy sheet.

8. The bracket of claim 7, wherein the bracket has:

a pole axis is defined through said tent pole orifice by the direction of force application to the bracket by an insertable tent pole;

a hook axis is defined through said termination hook by the direction of force application to the termination hook by an attachable canopy sheet, and said pole axis and said hook axis are substantially parallel.

* * * * *